United States Patent [19]

Freeman et al.

[11] 4,209,379

[45] Jun. 24, 1980

[54] CATHODE STRIPPING SYSTEM

[75] Inventors: George M. Freeman, Dollard des Ormeaux; Victor E. Robinson, Porcupine, both of Canada

[73] Assignee: Texasgulf Canada Ltd., Stamford, Conn.

[21] Appl. No.: 49,295

[22] Filed: Jun. 18, 1979

[51] Int. Cl.[2] ..... C25C 7/00; C25C 7/08

[52] U.S. Cl. ..... 204/198; 204/281

[58] Field of Search ..... 204/297 R, 297 W, 281, 204/286, 194, 198, 202, 203

[56] References Cited

U.S. PATENT DOCUMENTS

| | | | |
|---|---|---|---|
| 3,689,396 | 9/1972 | Casagrande | 204/281 |
| 3,840,032 | 10/1974 | Sitges | 204/281 |
| 4,131,531 | 12/1978 | Kaneko | 204/198 |

*Primary Examiner*—T. M. Tufariello

*Attorney, Agent, or Firm*—Kenyon & Kenyon

[57] ABSTRACT

A system for stripping electrolytically deposited zinc from relatively small size cathode sheets having a submerged or zinc plating area of approximately one square meter. A frame member is provided for supporting the cathode sheet holding arms which are mounted so as to permit the adjacently spaced sheets to move with respect to one another sufficient to facilitate mechanical stripping of the sheets. A water supply is further provided in the frame for washing the sheets prior to stripping. Once stripped, the sheet is lowered onto a conveyor which removes the zinc sheet from the frame area and stacks it adjacent one end of the frame.

7 Claims, 10 Drawing Figures

CATHODE STRIPPING SYSTEM

BACKGROUND OF THE INVENTION

This invention relates generally to a system for stripping sheets and more particularly to one for stripping and removing zinc sheets from aluminum cathodes.

The stripping of sheets from cathodes is generally a cumbersome and laborious operation. Further, aluminum cathode sheets are easily damaged by the ploughs customarily used to loosen the zinc away from the aluminum. In stripper carrying systems, the removal is further complicated by a failure to adequately support the aluminum sheet which is free to move during the stripping operation. Because of these various factors, units for mechanical stripping of cathode sheets are generally adapted for singular stripping operations.

Mechanized stripping has heretofore been proposed. These systems, however, have not met with any great deal of success particularly with respect to stripping of small cathode size sheets having approximately a 1.1 square meter plating surface. Thus, recent efforts have generally been directed to systems which employ jumbo or large size electrodes in order to make the system more productive.

By means disclosed herein, a mobile module suitable for receiving, washing, conveying and stacking stripped cathode sheets is disclosed which overcomes many of the disadvantages of the prior art. Further, by usage of this system a multiple number of sheets may be stripped in a single frame member. Also, usage of the system disclosed herein enables stripping of a longer and heavier zinc deposit with less physical abuse of electrode.

SUMMARY OF THE INVENTION

Briefly stated, the invention is directed to a system for stripping electrolytically deposited zinc from a plurality of cathode sheets. In this connection, a frame member is provided for supporting the plurality of cathode sheets to be stripped. The frame is of a generally rectangular configuration having the front end thereof open and supported on each side by end stands. A connecting member is fastened to each of the end stands to complete the supporting structure. Cathode sheet holding means are supported by the connecting member and spaced from one another a distance sufficient to permit access to the sheet to be stripped from the open side of the frame. A conveyor is disposed beneath the frame for the entire length thereof so as to receive and convey the stripped zinc cathodes to a stacking station. At one end of the conveyor adjacent the stacking station, an upwardly inclined section is included in order to raise the stripped sheet and facilitate the stacking of sheets adjacent to the conveyor.

Further features of the present invention include a platform hinged to the end stands suitable for positioning at the front open end of the frame member to provide a working platform for the operator. A water supply is provided adjacent the connecting member with outlets therefrom forming a supply of water routed to the cathode sheet holding means to facilitate the washing of the sheets prior to stripping.

The entire frame member is mobile and mounted on parallel tracks disposed on each side of the conveyor. Wheels are provided at the base of the frame member end stands to permit the entire frame to be removed while another frame may be rolled into position. To facilitate the stripping of a large number of cathode sheets, the frame members are provided in pairs positioned adjacent and coupled to one another.

As mentioned, the cathode sheet holding means are mounted to the connecting member in such a manner to permit pivotal movement about the point of connection. Mounting is thus provided by means of a conventional fastener pivotally connecting the cathode holding means to the connecting member. To permit movement necessary to perform stripping, the cathode holding member mounting point is spaced from the adjacent member mounting point with adjacent members being pivotally movable until in engagement with the adjacently spaced holding member. Thus, pivotal movement is permitted which allows for the mechanical stripping of adjacently spaced cathode sheets.

Accordingly, it is an object of this invention to provide a system by which efficient stripping of electrolytically deposited zinc from cathode sheets is accomplished.

It is a further object of this invention to provide a system for stripping zinc sheets from a plurality of adjacently spaced aluminum cathodes.

It is still another object of this invention to provide a system in which receiving, washing, conveying and stacking of stripped cathode zinc sheets is accomplished.

These and other objects, advantages and features of the invention will become more apparent from the following description taken in accordance with the accompanying drawings.

DESCRIPTION OF THE PREFERRED EMBODIMENT

Figure 1:
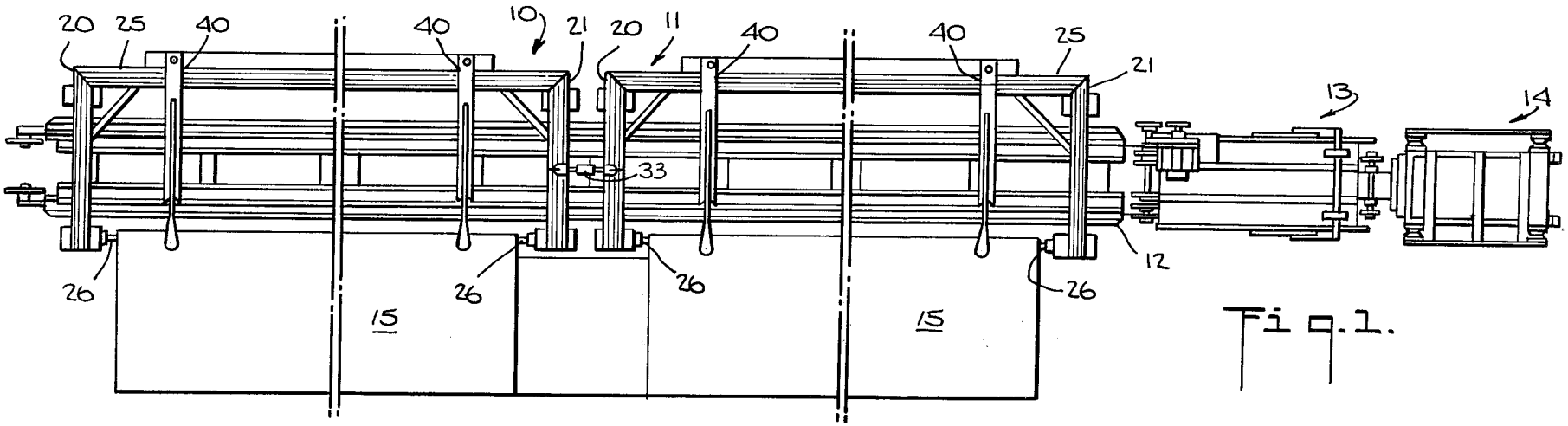
FIG. 1 is a plan view of the cathode stripping system of this invention.
Figure 2:
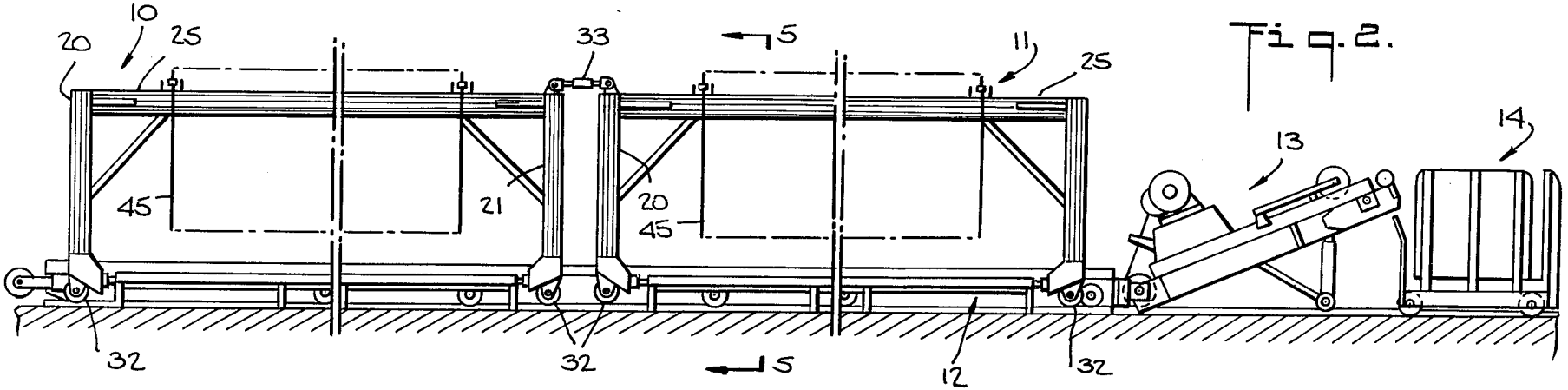
FIG. 2 is a side elevation view of the cathode stripping system of this invention.
Figure 3:
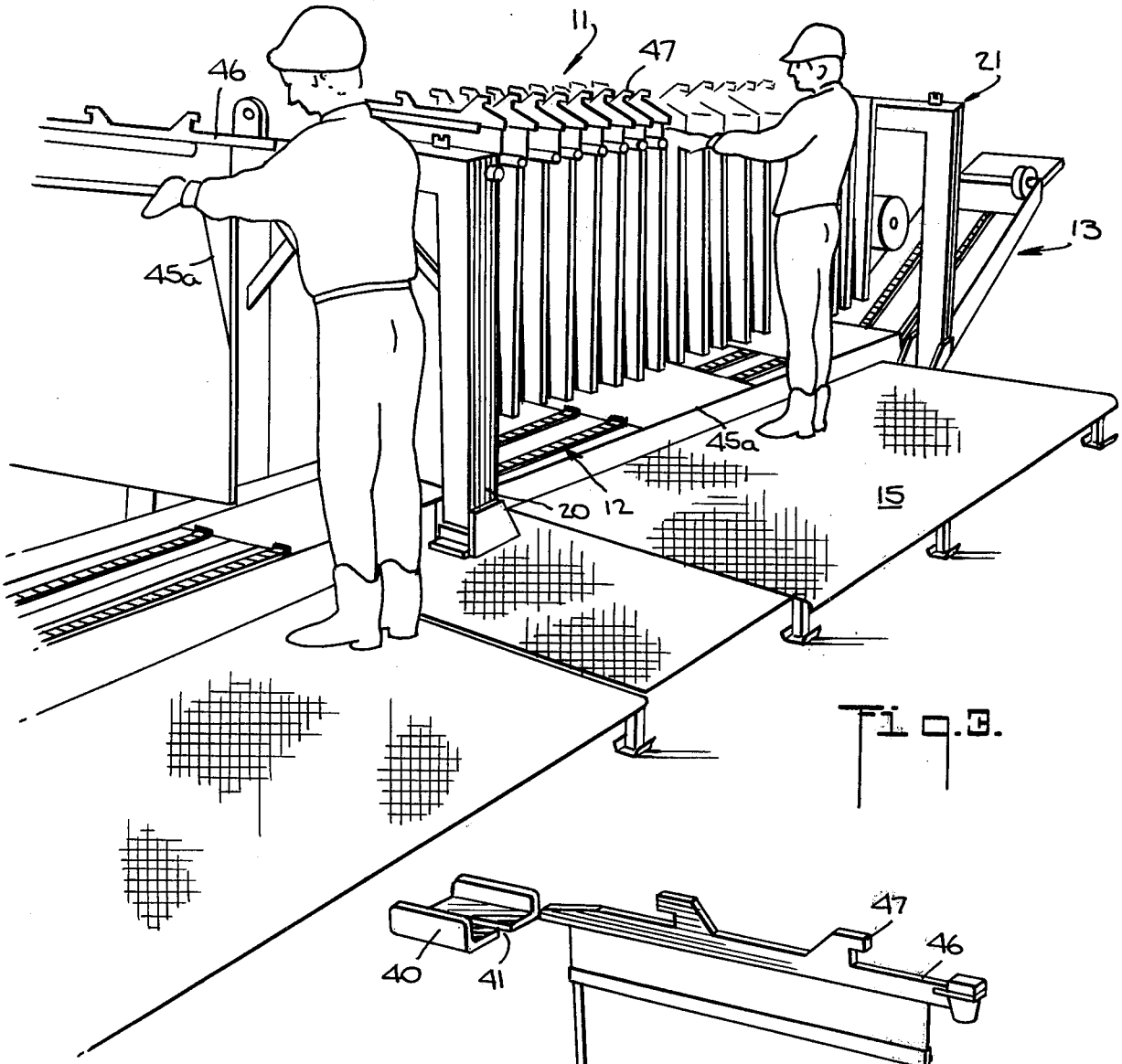
FIG. 3 is a perspective view of the cathode stripping system of this invention.

With reference to the drawings and particularly FIGS. 1-3, the cathode stripping system of this invention includes a pair of adjacently spaced vertical frame members 10 and 11 each of which is substantially identical. Disposed beneath the adjacently spaced frames 10 and 11 is a conveyor system 12 including an inclined section 13 which terminates adjacent a stacking or collecting means 14. To assist the cathode stripping operation, each of the frame members 10 and 11 is provided with a platform 15.

Each of the vertical frame members 10 and 11 include end stands 20 and 21 which are of a generally inverted U-shape construction including vertical legs 22 and 23. Legs 22 and 23 are connected to one another by the horizontal cross member 24, thus forming the inverted U-shape end stands 20 and 21. End stands 20 and 21 are connected to one another at the rearward portion by means of the longitudinal member 25, thus completing a vertical frame having an open front end. Adjacent the open front end is platform 15 which is pivotally mounted at 26 to the forward leg of each end stand 20 and 21.

Figure 5:
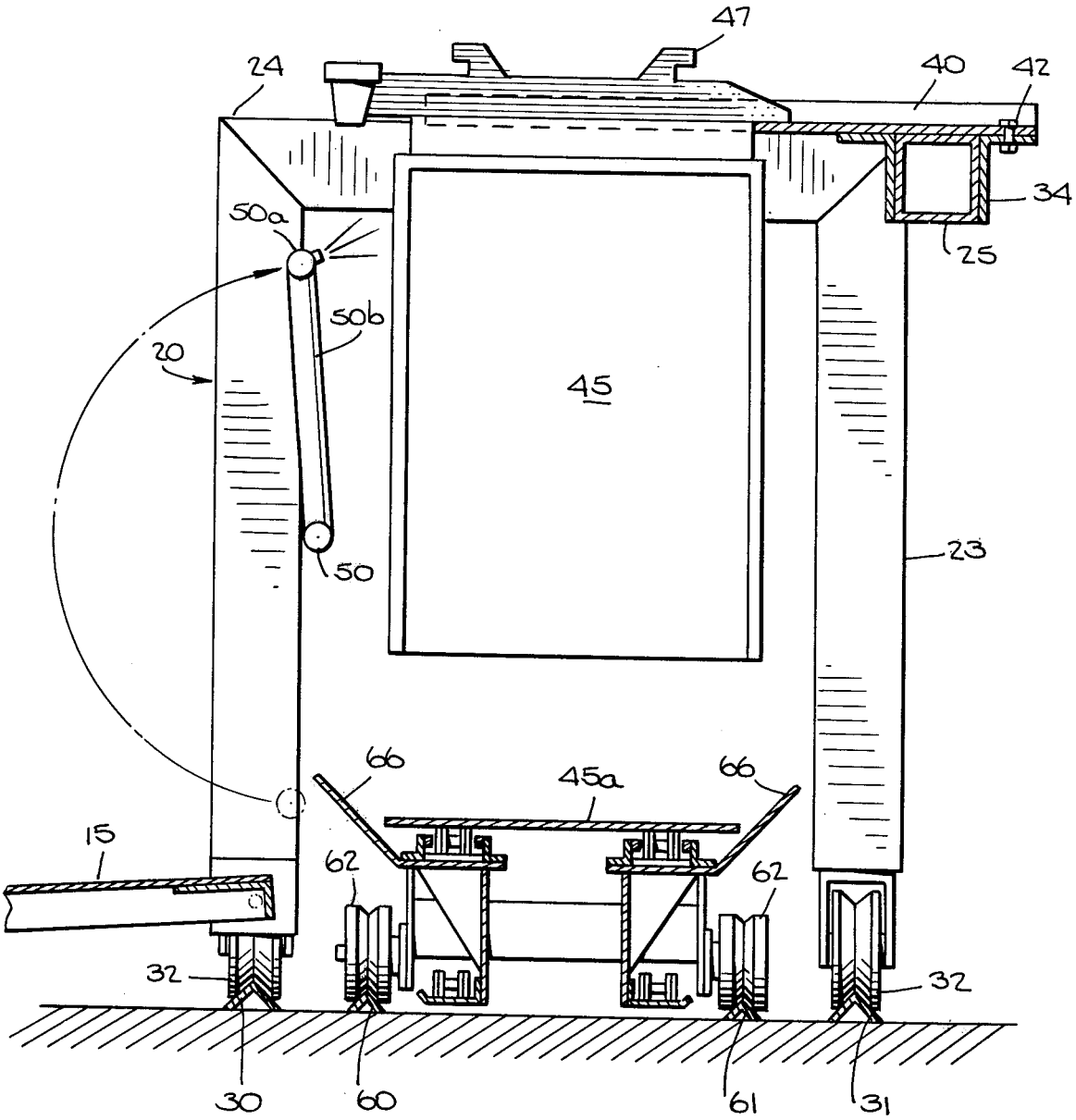
FIG. 5 is an end elevation view, partly in cross-section, taken along the line 5—5 of FIG. 2.
Figure 6:
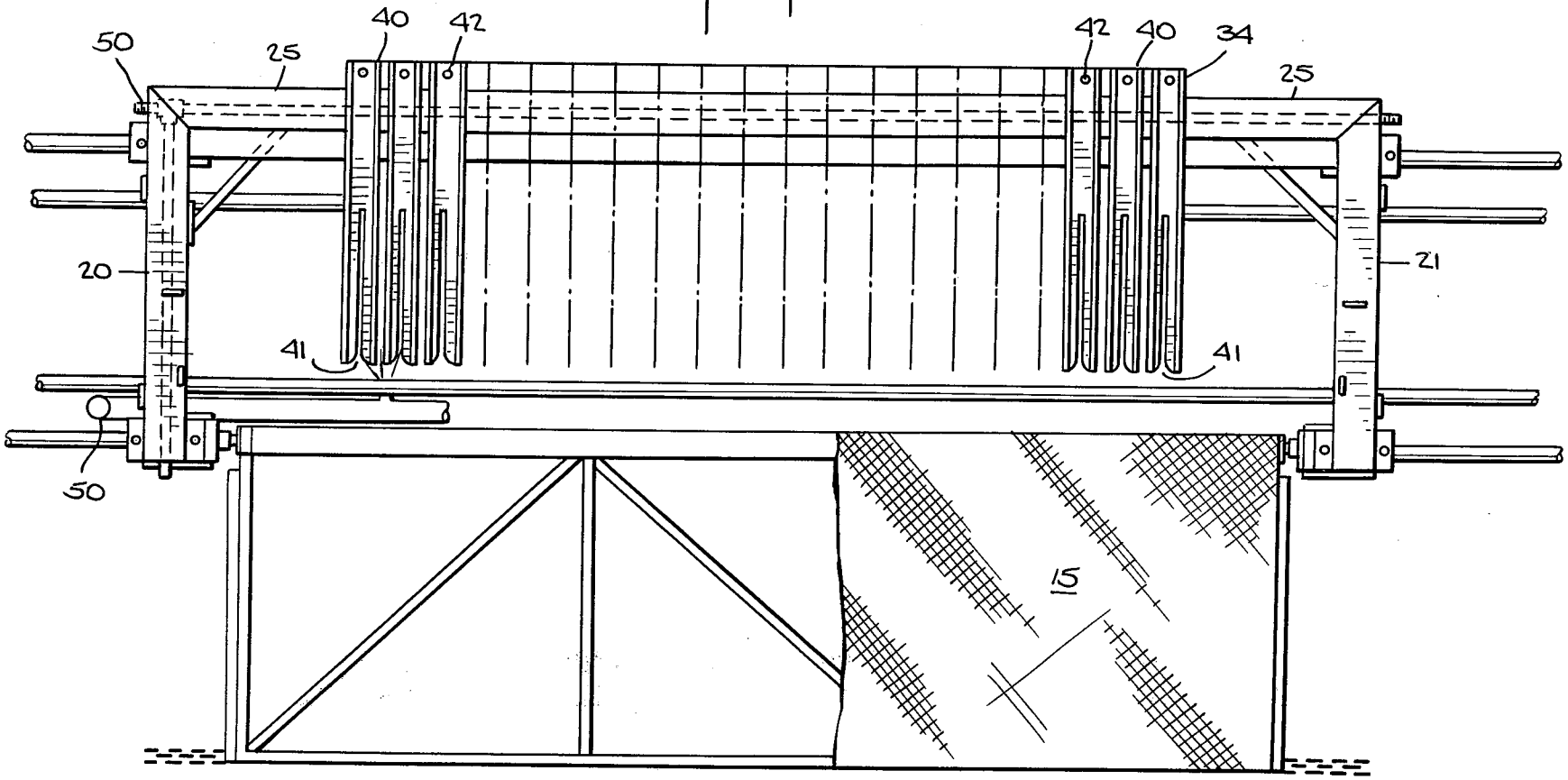
FIG. 6 is an enlarged plan view of one cathode sheet holding frame.
Figure 7:
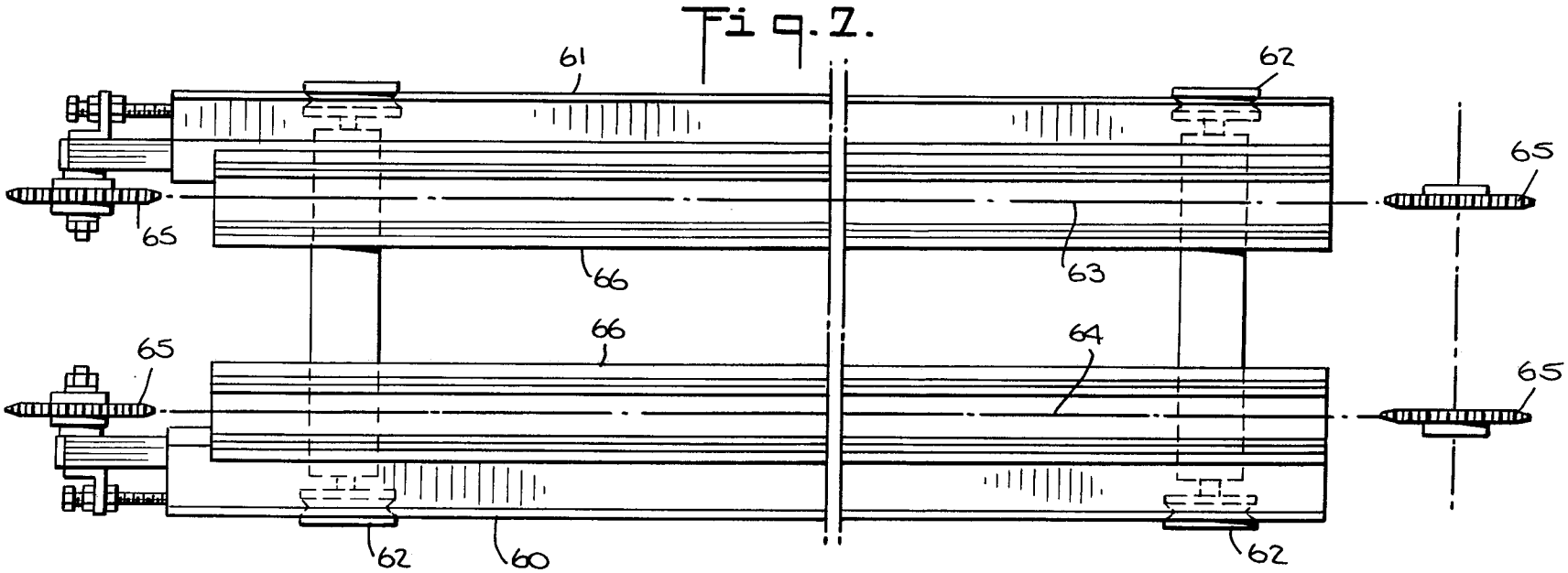
FIG. 7 is a plan view of the conveyor employed in the cathode stripping system of this invention.
Figure 8:
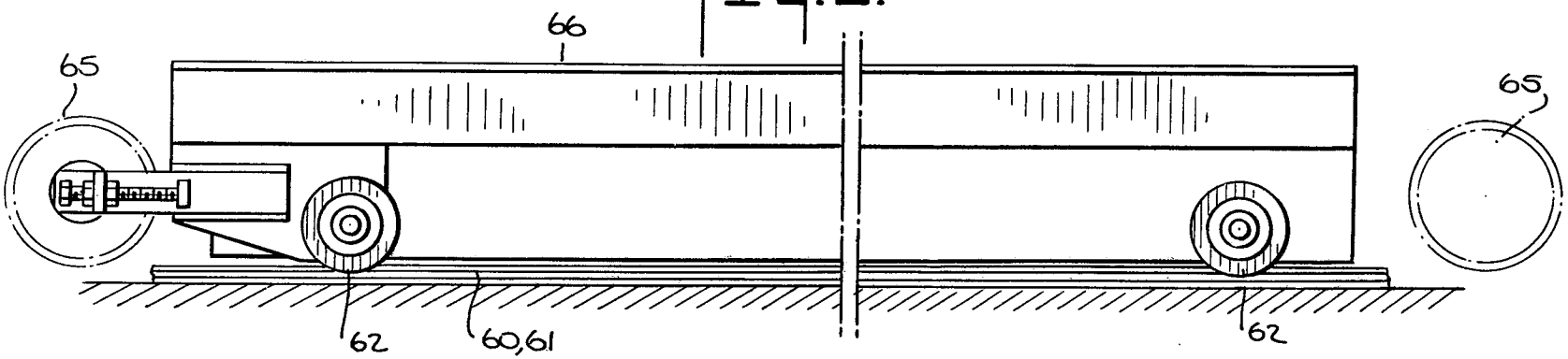
FIG. 8 is a side elevation view of the conveyor employed in the cathode stripping system of this invention.

Disposed beneath frame members 10 and 11 are generally V-shaped rails 30 and 31 (FIG. 5). Each leg 22 and 23 of end stands 20 and 21 is provided with a rotatable wheel 32. In this manner, a complete frame assembly and lower conveyor system is mobile and thus may be moved into alternate positions for the stripping of other rows. Once stripping has been concluded, the module can be readily removed and made available to the next stripping location. In normal practice, each of the frames is coupled to one another by a coupling means 33 (Fig. 1).

Figure 4:
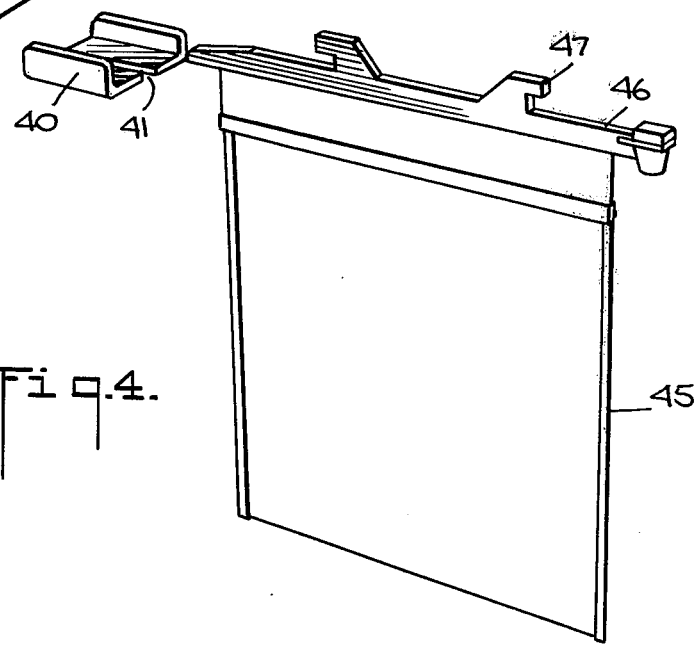
FIG. 4 is a perspective view depicting a cathode sheet being inserted into a cathode holding arm.

Longitudinal connecting member 25 includes mounted thereto a support member for supporting the cathode sheets to be stripped. Specifically, an L-shaped support 34 is attached to the rearward portion of longitudinal member 25 (FIG. 5). Cathode sheet holding arms 40 are of a U-shaped configuration having a slot 41 in the approximate center thereof (FIG. 4). At the rearward end, a hole is provided to facilitate mounting the holding arm 40 to L-shaped support 34 by means of a conventional fastener 42. The cathode sheet holding member may thus be pivotally rotated about the fastener 42 during the stripping operation. In the preferred embodiment, each frame member 10 and 11 has a capacity for holding twenty cathode sheets to be stripped, total system capacity thus being 40. The sheets are of a relatively small size, having a submerged or zinc plating area of approximately 1.1 square meter. Cathode holding arms 40 have their fastening point spaced from the adjacent arm a distance sufficient to allow each member to be pivoted about fastener 42 a sufficient distance to permit stripping before it becomes abutted against the adjacent member.

The cathode sheet 45 which is to be stripped is a 3/16" aluminum base sheet and includes an electrolytically deposited zinc sheet which extends up to approximately 4" from the top of the cathode sheet. A header bar 46 which includes ears 47 extending upwardly, is fastened to the cathode sheet 45. The sheet is slid into the U-shaped holding arm 40 by sliding the sheet support into slotted arm 41. The thickness of the holding arm 46 being greater than the width of the slot, facilitates sheet support during the stripping operation. To assist in the mechanical stripping of the zinc sheets from the cathode, a water supply is provided in the frame member, the inlet being indicated at 50. Water discharge sprays **50*a* are provided downstream of the water inlet 50, a discharge spray being provided in conjunction with each sheet holding member 40 to permit washing of the cathode sheets as necessary prior to stripping. The discharge spray is disposed at the end of the pivotable arm 50*b* adjacent the sheet holding member 40**.

Figure 9:
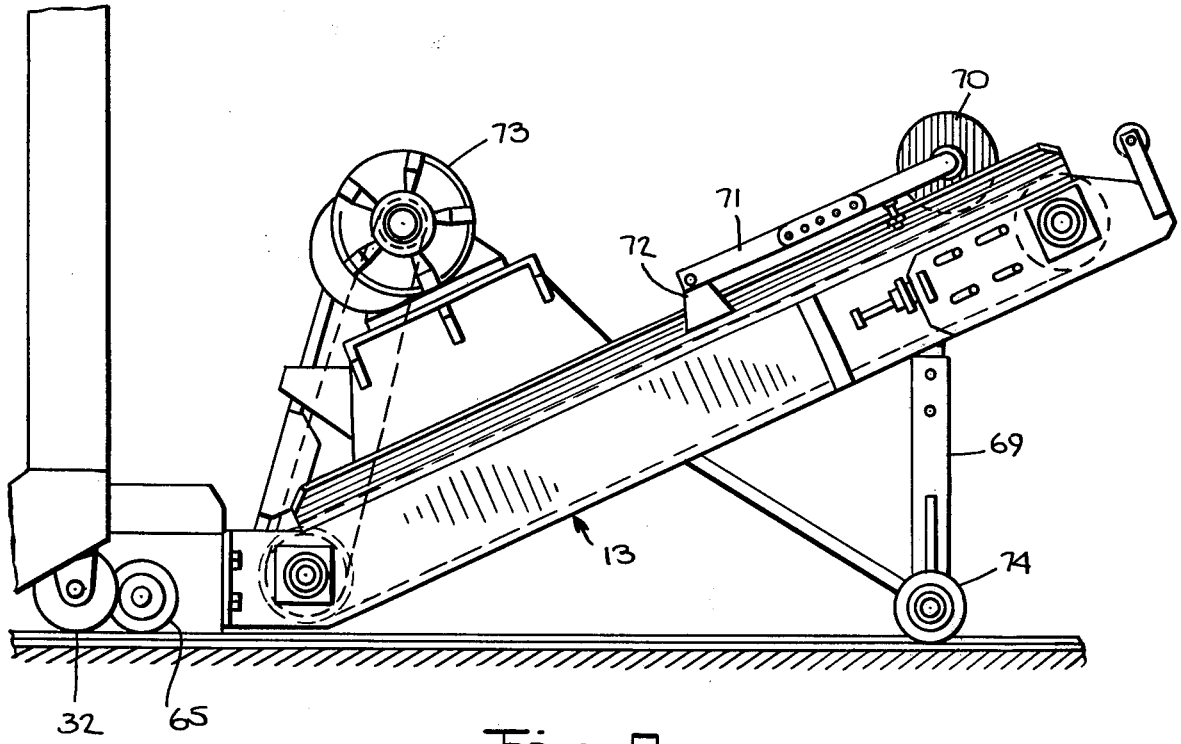
FIG. 9 is an enlarged side elevation view of the inclined section of the conveyor.
Figure 10:
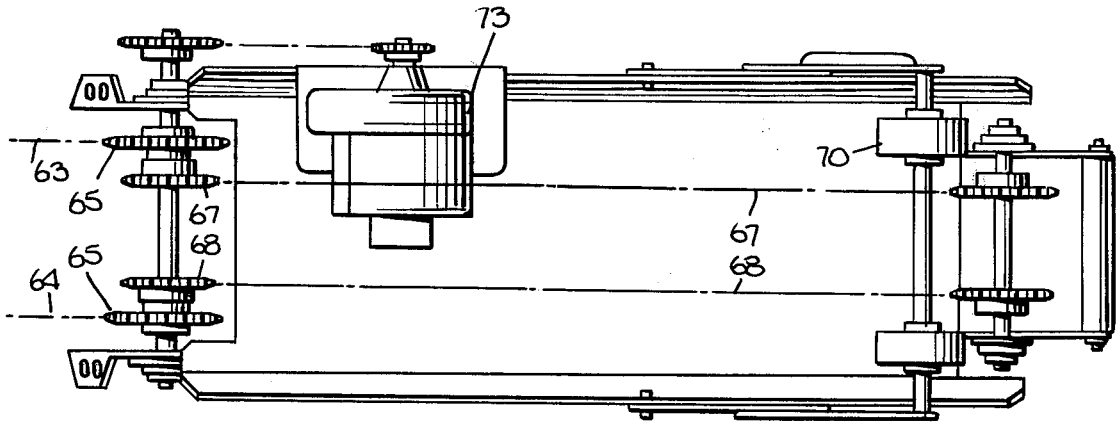
FIG. 10 is a top elevation view of the inclined section of the conveyor.

A second set of generally V-shaped rails or tracks 60 and 61 is provided inside the frame member rails 30 and 31 (FIG. 5). Rails 60 and 61 support a horizontal endless conveyor system mounted on wheels 62. The conveyor system includes a pair of spaced chains driven over end pulleys 65. Guide channels 66 are vertically inclined adjacent the end portions of the chains 63 and 64 and serve to prevent slippage of the sheet from the conveyor system. The end section of the conveyor system is upwardly inclined to a predetermined height depending upon the amount or weight of sheets to be stacked (FIG. 9). In this connection, chains 63 and 64 terminate adjacent a conventionally driven set of chains 67 and 68 which terminate adjacent stacking receptacle 14. The inclined portion of the conveyor system 13 is supported by means of the leg 69. Inclined section 13 of the conveyor is also movable being mounted on wheels 74 at the bottom of leg 69.

To assist in the removal of the sheet from the end of the conveyor on to the stacking receptacle, a pivotable wheel 70 is mounted to the frame member 13. Wheel 70 is pivotal with respect to the frame 13 being mounted on arm 71 which is pivotally connected to stationary member 72. The conveyor system is driven by a variable speed motor 73 which is directly connected to chain drive members 63, 64, 67 and 68.

Once the mechanical stripping of the zinc sheet **45*a* is completed, the sheet is lowered onto the conveyor which carries the stripped sheet away from the frame members. As the stripped sheet proceeds up the inclined portion of the conveyor 13, it then tends to fall into the stacking receptacle 14, being guided by means of the rotatable wheel 70**. In this manner a multiple number of sheets may be stripped in a single frame member. The system is thus suitable for receiving, washing, conveying and stacking the stripped cathode sheets. Moreover, because of the modular construction, the entire assembly is movable and another delivery of sheets which require stripping is readily substituted into position for those already stripped. Also, because of the stability provided by the frame system during the stripping procedure, longer and heavier zinc deposits may be stripped with less physical abuse to the electrode. Thus, by usage of the system disclosed herein, efficient stripping of zinc sheets from a plurality of adjacently spaced aluminum cathodes may readily be accomplished.

Although the above description is directed to a preferred embodiment of the invention, it is noted that other variations and modifications will be apparent to those skilled in the art and, therefore, may be made without departing from the spirit and scope of the present disclosure.

The embodiments of the invention in which an exclusive property or privilege is claimed are as follows:

1. A system for stripping electrolytically deposited zinc on a cathode sheet which comprises a vertically standing frame for supporting a plurality of cathode sheets to be stripped, said frame having the front side thereof open and being of a generally rectangular configuration formed by end stands each of which includes a pair of leg members, means connecting the rearward portion of said end stands to one another, a plurality of cathode sheet holding means each being adapted to hold a cathode sheet, a plurality of mounting means disposed on said connecting means suitable for mounting said cathode sheet holding means, said mounting means being spaced from one another allowing sufficient pivotal movement of said cathode sheet holding means to permit access to the face of each sheet from the open side of said frame in order to perform the stripping operation, and conveyor means adapted to receive and convey the stripped zinc cathode disposed beneath the length of said frame, said conveyor means being upwardly inclined to a predetermined height at the downstream end thereof so that a plurality of said stripped zinc sheets may be stacked adjacent the end of said conveyor.

2. A system in accordance with claim 1 which further includes a platform pivotally mounted to one of the leg members of each of said end stands at the open side of said frame.

3. A system in accordance with claim 1 which further includes a water supply disposed within said connecting means and a water discharge means associated with each of said cathode holding means, said water discharge means being operatively connected to said water supply means and directed toward said cathode sheet to facilitate washing of said sheet prior to stripping.

4. A system in accordance with claim 1 which further includes a rotatable wheel disposed at the end of said upwardly inclined portion of said conveyor to assist in the removal of stripped zinc sheets from said conveyor.

5. A system in accordance with claim 4 which further includes a pair of spaced rail members disposed beneath said conveyor means and wheels mounted at each end of said conveyor means adapted to engage said rail members in order to allow for movement of said conveyor means with respect to said frame.

6. A system in accordance with claim 1 wherein said cathode sheet holding means are adapted to hold cathode sheets having a submerged or zinc plating area of approximately one square meter.

7. A system in accordance with claim 1 which further includes a pair of spaced rail members disposed beneath said frame, each of said rail members being located on one side of said conveyor and wherein said end stand leg members include wheels on the lower portion thereof adapted to be mounted on said rail members in order to allow for movement of said frame with respect to said conveyor means.

* * * * *